US005428980A

United States Patent [19]

Iidaka

[11] Patent Number: 5,428,980

[45] Date of Patent: Jul. 4, 1995

[54] METHOD AND APPARATUS FOR PRODUCING CAP FOR DRINK BOTTLE

[76] Inventor: Tsuguo Iidaka, 122-2 Hinatacho, Sukagawa-shi, Fukushima-ken, Japan

[21] Appl. No.: 171,360

[22] Filed: Dec. 23, 1993

Related U.S. Application Data

[63] Continuation-in-part of Ser. No. 921,764, Jul. 30, 1992, abandoned.

[30] Foreign Application Priority Data

Aug. 26, 1991 [JP] Japan ..... 3-236799

[51] Int. Cl.[6] ..... B21D 22/16

[52] U.S. Cl. ..... 72/83; 72/85

[58] Field of Search ..... 72/82, 83, 84, 85, 110

[56] References Cited

U.S. PATENT DOCUMENTS 813,604 2/1906 Watzke ..... 72/83

3,109,400 11/1963 Paulton ..... 72/83

FOREIGN PATENT DOCUMENTS 1294444 3/1987 U.S.S.R. ..... 72/85

1493356 7/1989 U.S.S.R. ..... 72/85

*Primary Examiner*—Lowell A. Larson

*Attorney, Agent, or Firm*—Lorusso & Loud

[57] ABSTRACT

A cap to be fitted around a neck portion of a drink bottle is produced from a cap blank by employing a spinning process. First, the cap blank is fitted around the distal end of a movable guide arranged surrounding a die shaft serving as a spinning mandrel, and thereafter, a spinning operation is performed for the cap member by two rollers adapted to successively come in contact with the cap member. One of the rollers is a rough spinning roller and the other one is a finishing roller which serves to glaze the surface of the cap member. The rollers are positioned offset from each other, not only in the axial direction, but also in the circumferential direction. While the die cap is firmly held between the die shaft and a pressing member of a pressing unit, the die shaft is rotated, causing the cap member and both the rollers to be rotated by the die shaft. Subsequently, the movable guide is axially displaced away from the distal end of the die shaft, and both the rollers are axially displaced in synchronization with the movable guide for performing the spinning operation.

12 Claims, 6 Drawing Sheets

METHOD AND APPARATUS FOR PRODUCING CAP FOR DRINK BOTTLE

CROSS-REFERENCE TO RELATED APPLICATION

This application is a continuation-in-part of U.S. application Ser. No. 07/921,764 filed Jul. 30, 1992 now abandoned.

BACKGROUND OF THE INVENTION

1. Field of the Invention

The present invention relates to a method and an apparatus for producing a cap having a very small thickness to be fitted around a neck portion of a drink bottle such as a wine bottle or the like. Further, the present invention relates to a cap having a very small thickness to be fitted around a neck portion of a drink bottle such as a wine bottle or the like wherein the cap is produced using aluminum or aluminum alloy as a blank.

2. Description of the Prior Art

To protect a neck portion of a drink bottle such as a wine bottle or the like from damage or injury, and moreover, maintain the neck portion in a clean state, a cap made of a metallic material is normally fitted around the neck portion of the bottle. Generally, the metallic cap is produced using a sheet of lead having both surfaces covered with tin foil. To plastically deform the sheet of lead to a contour corresponding to a cap product, a so-called spinning process has been heretofore employed wherein the sheet of lead is spun by manually actuating a specially designed tool while the sheet is rotated.

When a metallic cap is produced by employing the foregoing spinning process, the thickness of a blank can not usually be reduced to 0.2 mm or less. Thus, with the conventional spinning process, there arises a drawback that material cost is increased because of the comparatively heavy thickness and the employment of an expensive metallic material like tin. Another drawback is that the surface of the cap produced by the spinning process can not exhibit a brilliant appearance. In addition, careless disposal after removal of the lead cap from the neck portion of a drink bottle may cause pollution. For this reason, it is anticipated that employment of lead for the cap will be prohibited in the future.

Given the circumstances described above, attention has recently turned to aluminum as a metallic material to be fitted around the neck portion of a bottle, because aluminum is a cheap metallic material, does not cause any public pollution after disposal and, moreover, can be reused by melting it.

With the conventional process, however, a cap having a very small thickness can be produced using a soft metallic material like lead but can not be produced when a comparatively hard metallic material like aluminum is employed as a raw material.

SUMMARY OF THE INVENTION

An object of the present invention is to provide a method of producing a cap to be fitted around a neck portion of a drink bottle wherein the cap has a very small thickness, as compared with a conventional cap, and exhibits a brilliant appearance over its full length.

Another object of the present invention is to provide an apparatus for effectively practicing the foregoing method.

A further object of the present invention is to provide a cap having a very small thickness to be fitted around a neck portion of a drink bottle wherein the cap is made of aluminum or aluminum alloy at an inexpensive cost with a reduced thickness compared with the conventional cap.

According to a first aspect of the present invention, there is provided a method of producing a cap having a very small thickness to be fitted around a neck portion of a drink bottle, the cap member having a bottom and a cylindrical portion integrated with the bottom, the cylindrical portion having a thickness slightly larger than that of the bottom. The method comprises the steps of firmly holding the cap member between the distal end of a die shaft serving as a forming mandrel and the distal end of a pressing member; rotating the die shaft together with a movable guide surrounding the die shaft in a spaced relationship, with an annular gap kept therebetween; rotating the cap member by the die shaft as the latter is rotated; successively bringing a plurality of rollers into contact with the cap member, the rollers being located positionally offset from each other through an angle $\theta$; and displacing both the rollers in the axial direction in synchronization with axial displacement of the movable guide, causing the cap member to be plastically deformed to assume the same contour as that of the die shaft.

It is recommended that a pair of rollers be used, one of them being a rough spinning roller serving as a working roller for plastically deforming the cap member to reduce its thickness and the other one being a finishing roller for glazing the surface of the cap member. The finishing roller is located offset from the rough spinning roller, not only in the axial direction by a distance "X", but also in the circumferential direction through an angle $\theta$, such that the rough spinning roller is axially displaced ahead of the finishing roller.

Usually, the die shaft has a tapered configuration such that its diameter is gradually reduced toward its distal end within the range defined by a predetermined distance as axially measured from its distal end. Alternatively, the die shaft may be rod-shaped with a constant diameter over a predetermined distance as axially measured from its distal end.

It is desirable that the cap member is prepared from aluminum or aluminum alloy. This is because aluminum or aluminum alloy makes it possible to substantially reduce the thickness of the cap compared with a conventional cap member made of a soft metallic material such as lead or the like.

In addition, according to a second aspect of the present invention, there is provided an apparatus for producing a cap having a very small thickness to be fitted around a neck portion of a drink bottle, the cap member having a bottom and a cylindrical portion (skirt) integral with the bottom, the cylindrical portion having a thickness slightly larger than that of the bottom. The apparatus comprises a rotatable die shaft serving as a forming mandrel for determining the contour of the inner wall surface of the cap upon completion of production of same; a movable guide rotatably mounted and surrounding the die shaft, the movable guide being displaceable relative to the die shaft, in the axial direction; a plurality of rollers offset from each other, not only in the axial direction, but also in the circumferential direction for contact with the cap member, the rollers being rotated by the die shaft and axially displaced in synchronization with axial displacement of the movable guide; and a pressing unit for firmly holding the cap member in cooperation with the die shaft, the pressing unit including a pressing member rotated together with the cap member by the die shaft.

The pressing unit comprises a pressing member adapted to come in contact with the cap member, a splined plunger integral with the pressing member, a cylindrical column having a plurality of spline teeth formed around its interior surface for meshing with the splines on the splined plunger, a holder integral with the cylindrical column, and a coil spring disposed in the cylindrical column between the splined plunger and the holder so as to bias the pressing member out from the holder by the resilient force of the spring. As the die shaft is rotated, the pressing member is rotated by the die shaft via the cap member.

Further, according to a third aspect of the present invention, there is provided a cap having a very small thickness to be fitted around a neck portion of a bottle, wherein the cap is produced by employing the method and the apparatus of the present invention constructed in the above-described manner.

The cap is made of aluminum or aluminum alloy. It is preferable from the viewpoint of practical use that the cylindrical portion of the cap has an average thickness of 0.2 mm or less.

BRIEF DESCRIPTION OF THE DRAWINGS

The present invention is illustrated in the following drawings in which.

DESCRIPTION OF THE PREFERRED EMBODIMENTS

Now, the present invention will be described in detail hereinafter with reference to the accompanying drawings which illustrate preferred embodiments of the present invention.

Figure 1:
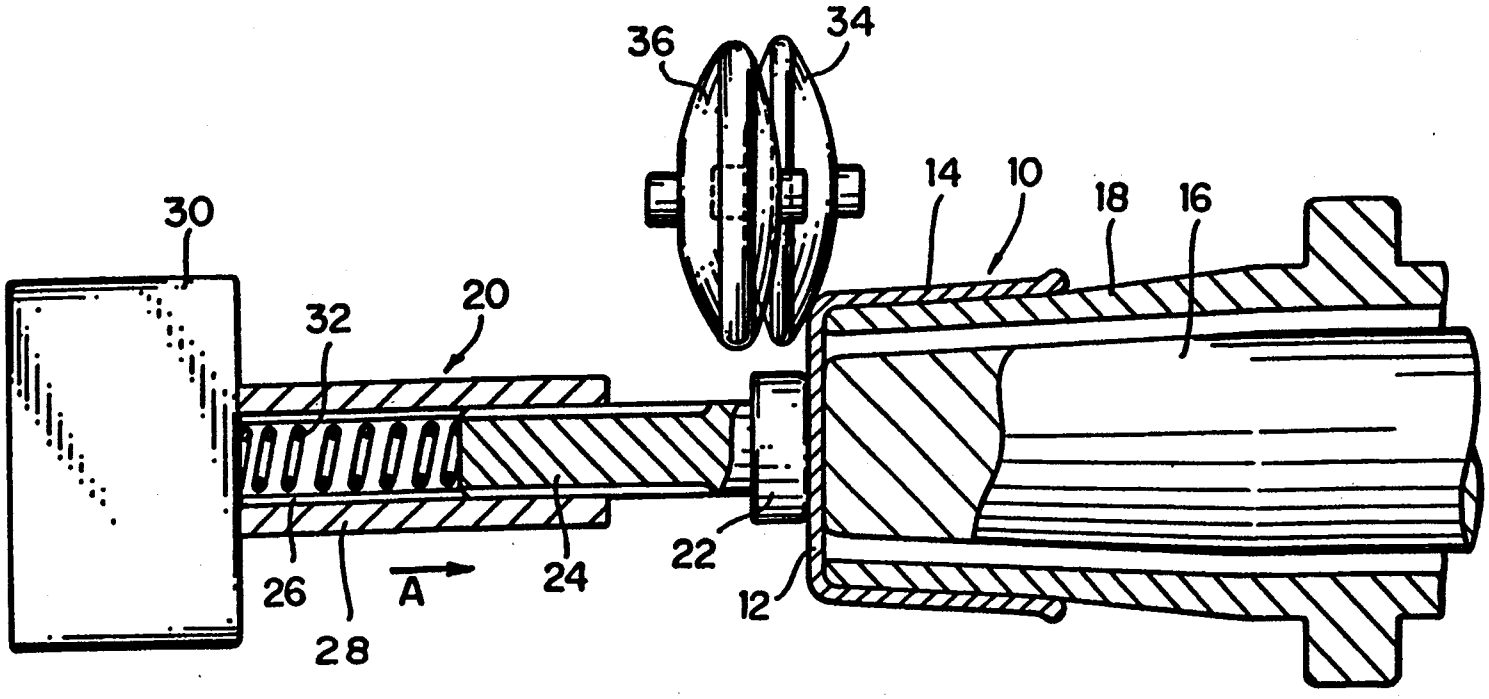
FIG. 1 is a sectional view of an apparatus for producing a cap to be fitted around a neck portion of a drink bottle in accordance with an embodiment of the present invention.

FIG. 1 is a sectional side view of an apparatus for producing a cap having a very small thickness to be fitted around a neck portion of a drink bottle (hereinafter referred to simply as "apparatus") in accordance with an embodiment of the present invention. In this embodiment, the cap product will have a tapered contour such that its diameter is greatest at its opening.

A cap member 10 is prepared as a blank (starting material) having a thickness slightly larger than that of the end product using a conventional blank press (not shown). The cap member 10 is composed of a circular bottom 12 and a cylindrical portion 14 integral with the circular bottom 12. As is apparent from the drawing, the cylindrical portion 14 is tapered so that both inner and outer diameters are greatest at the open end.

The apparatus includes a die shaft 16 serving as a forming mandrel for determining the exterior configuration of the cap product and a movable cylindrical guide 18 arranged outside of the die shaft 16 in a spaced relationship to provide an annular gap therebetween. The die shaft 16 has a tapered contour such that its diameter is gradually reduced toward its distal end within a range defined by a predetermined distance as axially measured from the distal end thereof. Similarly, the movable guide 18 is designed in the same tapered contour such that both its inner and outer diameters are gradually reduced toward its distal end within the range defined by a predetermined distance as axially measured from its distal end. The pressed cap blank 10 is configured so that it can be fitted around the outer periphery of the movable guide 18. The die shaft 16 and the movable guide 18 are rotated at the same rotational speed, in the same direction, by driving means (not shown). In addition, the movable guide 18 is movable in parallel with the center axis of the die shaft 16 while it is rotating.

With the die shaft 16 and the movable guide 18 not being rotated and with the distal end of the movable guide 18 positioned coincident with the distal end of the die shaft 16, the cap blank 10 is fitted around the distal end portion of the movable guide 18 as shown in FIG. 1. Thus, while the cap member 10 is fitted around the movable guide 18, the distal end of the die shaft 16 comes in contact with the bottom 12 of the cap member 10. When the distal end of the movable guide 18 is positionally coincident with the distal end of the die shaft 16, an annular gap "Y" is formed between the inner wall surface of the movable guide 18 and the outer wall surface of the die shaft 16. As the movable guide 18 is displaced from the foregoing position to the right as seen in FIG. 1, the annular gap "Y" between the inner wall surface of the movable guide 18 and the outer wall surface of the die shaft 16 is gradually reduced.

In addition, the apparatus includes a pressing unit 20 which serves to firmly hold the bottom 12 of the cap member 10 between the distal end of the die shaft 16 and the pressing member 22 of the unit 20. Specifically, the unit 20 consists of a pressing member 22 adapted to contact the bottom 12 of the cap member 10, a splined plunger 24 integral with the pressing member 22, a cylindrical column 28 having a plurality of spline teeth 26 formed around its interior wall for meshing with the splined plunger 24, a holding member 30 integral with the cylindrical column 28, and a coil spring 32 interposed between the holding member 30 and the splined plunger 24. With such construction, the pressing member 22 is normally biased outwardly of the cylindrical column 28 by the spring 32 while the splined plunger 24 is operatively engaged with the spline teeth on the interior of cylindrical column 28, whereby the pressing member 22 is normally in contact with the cap member 10 due to the resilient force of the spring 32, Thus, as long as the pressing member 22 contacts the cap member 10 in that way, the cap member is firmly held between the pressing member 22 and the die shaft 16, causing the pressing member 22 to rotate together with the cap member 10 as the die shaft 16 is rotated.

Figure 2:
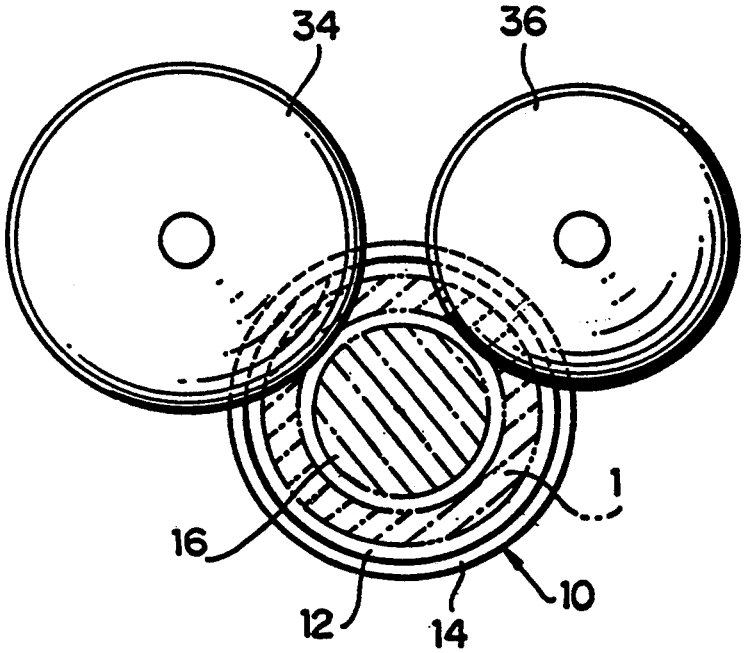
FIG. 2 is a side view of the apparatus as viewed in the A arrow-marked direction in FIG. 1, particularly illustrating the relative positions of two rollers, a cap member and a die shaft 1.

Additionally, the apparatus includes a rough spinning roller 34 serving as a spinning tool for reducing the thickness of the cap member 10 and a finishing roller 36 for glazing the surface of the cap member 10 as shown in FIG. 1. Both the rough spinning roller 34 and the finishing roller 36 are positioned where they contact the bottom 12 of the cap member 10 after the cap member 10 is fitted around the distal end of the movable guide 18. As is apparent from FIG. 1, the rough spinning roller 34 is positioned slightly nearer to the movable guide 18 than the finishing roller 36. As shown in FIG. 2, both the rough spinning roller 34 and the finishing roller 36 are arranged such that they partially radially overlap the movable guide 18 but they do not radially extend as far as the die shaft 16.

As the movable guide 18 is displaced, both the rough spinning roller 34 and the finishing roller 36 move by the same distance in the same direction. Thus, as both the rollers 34 and 36 move together with the movable guide 18, they come in contact with the cap member 10 which is rotated by the die shaft 16, whereby they are rotated by the rotational force of the die shaft 16 via the cap member 10.

Referring to FIG. 1 again, center axis 38 of the rough spinning roller 34 and center axis 40 of the finishing roller 36 are located in parallel with the rotational center axis of the die shaft 16 as seen in the axial direction. In practice, however, the center axes 38 and 40 of the rollers 34 and 36 are arranged such that the angle between the rollers 34 and 36 relative to the center axis of the die shaft 16 can freely be changed as desired.

Next, description will be made below as to how a cap having a very small thickness is produced by the above-described apparatus.

First, the cap member 10 is fitted around the distal end of the movable guide 18 as a blank, and thereafter, the bottom 12 of the cap member 10 is firmly held between the pressing member 22 of the pressing unit 20 and the die shaft 16. Subsequently, the die shaft 16, the movable guide 18 and the pressing unit 20 are rotated at the same rotational speed in the same direction. In other words, the cap member 10 is held immovable relative to the die shaft 16 by reason that the bottom 12 of the cap member 10 is clamped between the pressing member 22 of the pressing unit 20 and the die shaft 16, whereby the cap member 10 can be rotated at the same rotational speed in the same direction as the die shaft 16 is rotated.

Then, the die shaft 16 is rotated in order to rotate the cap 12 member 10. While this operative state is maintained, the movable guide 18, the rough spinning roller 34 and the finishing roller 36 are displaced to the right as seen in FIG. 1, causing both the rollers 34 and 36 to come in contact with the rotating cap member 10. As both the rollers 34 and 36 are rotated, a high intensity of forming force is imparted to the cap member 10 so that the cap member 10 is plastically deformed so as to cause the contour of the cap member 10 to conform to that of the die shaft 16. Specifically, first, the edge part of the cap member 10 around the bottom 12 of the same is deformed, and thereafter, the cylindrical portion 14 of the cap member 10 is deformed. Axial movement of the movable guide 18 relative to the die shaft 16 is coordinated with axial movement of the rollers 34 and 36; however, the force for axial movement of movable guide 18 is applied at the supported end thereof (not shown). In other words, the rollers 34 and 36 do not push the movable guide 18.

As the deformed cap member 10 is rotated while it is kept immovable relative to the die shaft 16 and the rough spinning roller 34 is displaced while contacting the cap member 10, the thickness of the cap member 10 is gradually reduced until the contour of the cap member 10 coincides with that of the die shaft 16. As a result, in contrast to the conventional cap made of a soft metallic material such as lead, tin or the like, a cap having a very small thickness and exhibiting the same contour as that of the die shaft 16 can be produced using a rigid metallic material like aluminum.

When the rough spinning roller 34 contacts against the cap member 10 and moves to the right, the cap member 10 is stably supported by the movable guide 18 over its entire cylindrical wall. As the movable guide 18 and both the rollers 34 and 36 are displaced in the rightward direction, the cap member 10 is increasingly spined by the rough spinning roller 34 and then glazed by the finishing roller 36 while it is firmly supported around the outer surface of the die shaft 16. Subsequently, the cap member 10 is plastically worked to same contour as that of the die shaft 16 until a finished cap is produced. It should be added that the unworked part of the cap member 10 located adjacent to the opening, behind the rough spinning roller 34, is not deformed during the spinning operation.

According to the present invention, two rollers comprising the rough spinning roller 34 and the finishing roller 36 are brought in contact with the cap member 10 with their positions offset through distance "X" as seen in the axial direction. Whit this arrangement, no portion of the cap member 10 spined by both the rollers 34 and 36 bulges during the spinning operation. On the contrary, if just a single roller is employed for the apparatus, the cap member 10 may undesirably bulge especially across the part of the cap member 10 spined by the roller, resulting in the contour of the cap member 10 failing to correctly coincide with that of the die shaft 16.

In the shown embodiment, two rollers are employed for the apparatus as mentioned above. Alternatively, three or more rollers may successively come in contact with the cap member 10 with positions offset between adjacent rollers. It should be noted that the finishing roller 36 is intended to improve appearance of the cap product by glazing the surface of the cap member 10.

Figure 3:
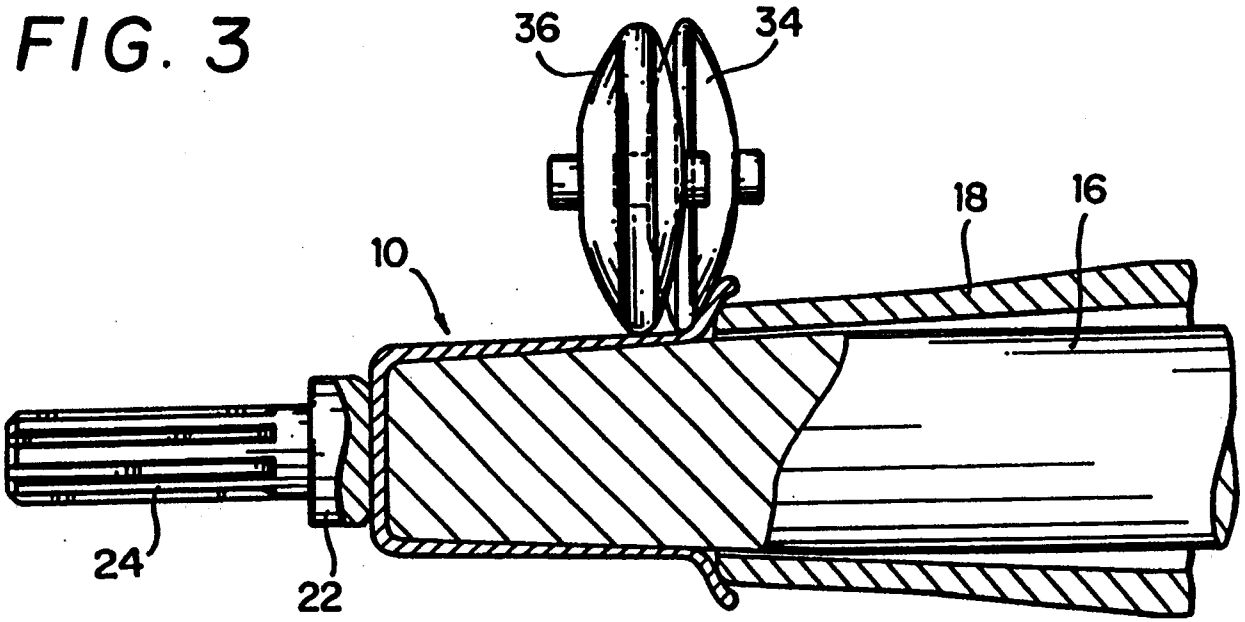
FIG. 3 is a sectional view of the apparatus shown in FIG. 1, particularly illustrating cooperative operation of two rollers and the movable guide, as they move from the position shown in FIG. 1 away from the bottom of a cap member, while rotated by the die shaft.

On completion of the spinning operation, the contour of the cap member 10 correctly coincides with that of the die shaft 16 and the inner diameter of the cap member 10 as a final product gradually decreases from the opening toward the bottom 12. Since the rough spinning roller 34 and the finishing roller 36 are displaced in parallel with the center axis of the die shaft 16 in the same manner as the movable guide 18, the thickness of the cap member 10 is gradually reduced more and more as the cap member 10 is spined toward the opening as shown in FIG. 3. In this embodiment, it is recommended that the cylindrical portion 14 of the cap member 10 have a thickness of 0.2 mm or less in its central portion.

Figure 4:
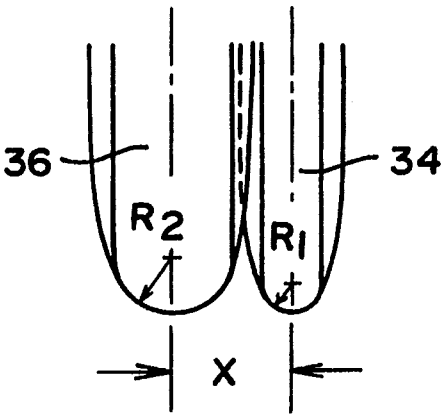
FIG. 4 is a schematic diagram illustrating the spacing between the rollers and the dimensional differences therebetween.
Figure 8:
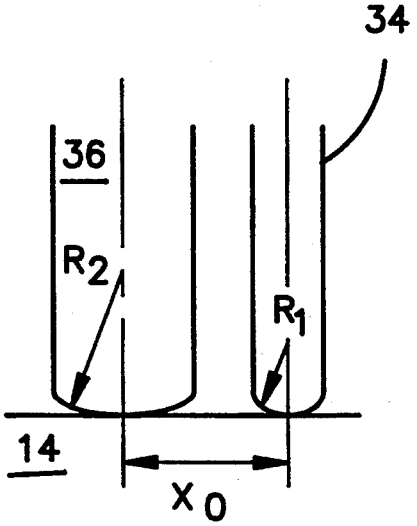
FIGS. 8 and 9 are schematic diagrams illustrating tilting of the rollers relative to the axis of the die shaft.
Figure 9:
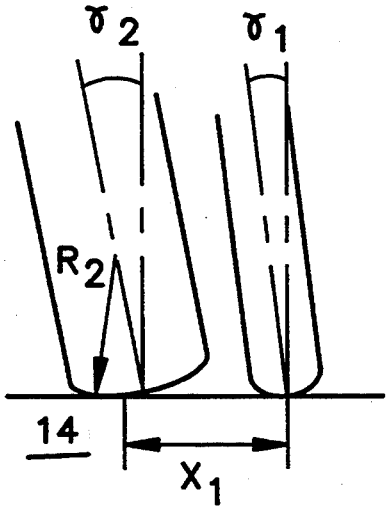

FIG. 4 illustrates the axial offset "X" between rollers 34 and 36 and, also, differences in the relative dimensions thereof, i.e. $R_2 < R_1$. More precisely, "X" is the axial distance between (1) the center of the area of contact between the roller 36 and cap skirt 14 and (2) the center of the area of contact between the roller 34 and cap skirt 14, as seen in FIGS. 8 and 9. The axial offset distance "X" is preferable $0<X\leqq 7$ mm and more preferably 1–5 millimeters. The value "X" may be suitably chosen within the foregoing range in accordance with the diameter and thickness of the cap to be produced. The ratio (R) of $R_1$ to $R_2$ may suitably be $1<R\leqq 7$ or, more preferably, $3<R\leqq 5$.

Figure 5:
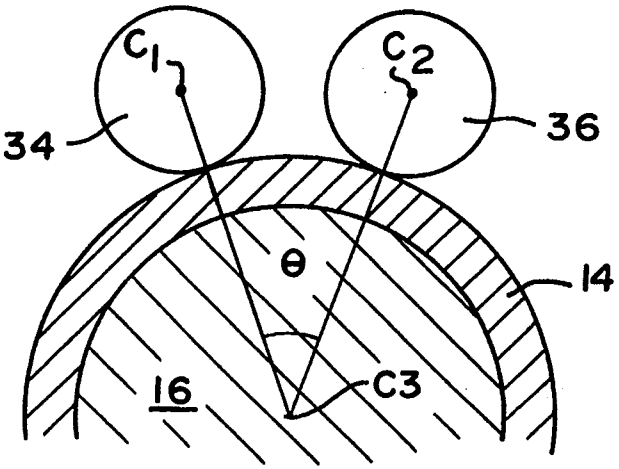
FIG. 5 is a schematic diagram illustrating the circumferential angular offset $\theta$.

FIG. 5 illustrates the relationship between rollers 34 and 36 in terms of the circumferential or angular offset $\theta$ therebetween. The angular offset $\theta$ is defined by lines passing through the center $C_1$ of roll 34 and center $C_3$ of die shaft 16 intersecting with a second line extending from the center $C_2$ of roller 36 through the center $C_3$ of mandrel 16. The lower limit for angle $\theta$ is the angle where the circumferences of 34 and 36 would be shown touching in FIG. 5. In other words, as seen in FIG. 5, rollers 34 and 36 would not overlap. The preferred upper limit for angle $\theta$ is 90°. In other words, angle $\theta$ is preferably an acute angle.

Figure 7:
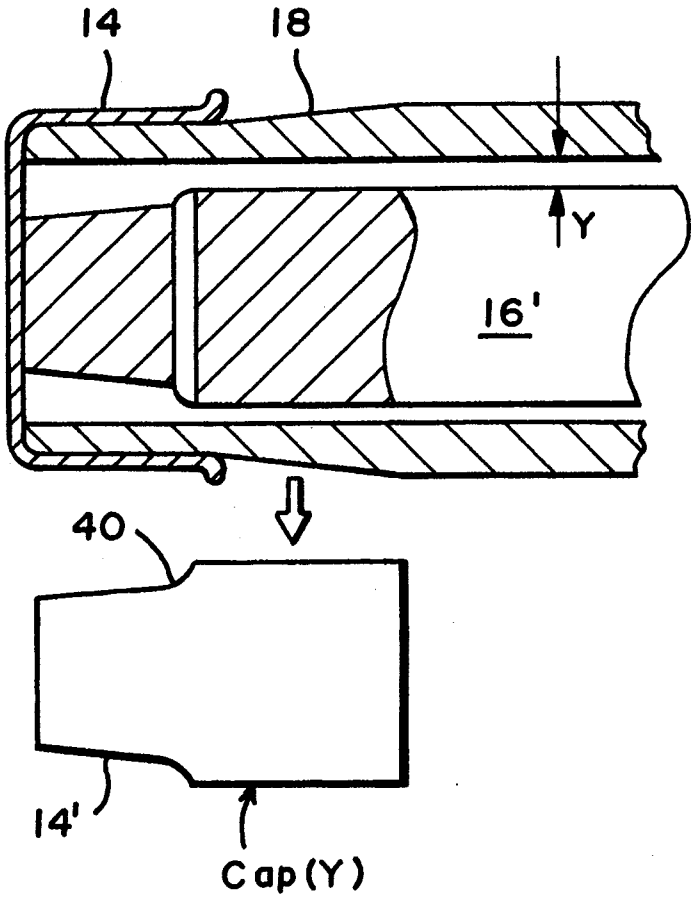
FIG. 7 is a schematic diagram, in cross-section, showing a die shaft used to form a cap having a stepped skirt.
Figure 6:
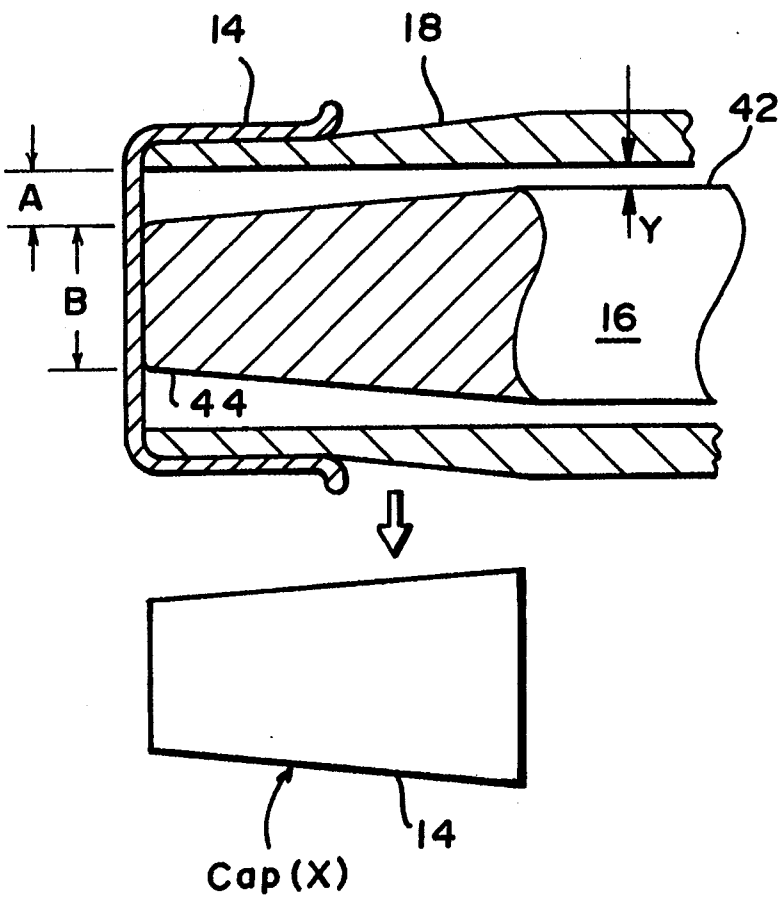
FIG. 6 is a schematic diagram, in cross-section, showing a die shaft used to form a cap having tapered skirt portion.

As best seen in FIGS. 6 and 7, a gap "Y" is provided between the straight cylinder section 42 of die shaft 16 and the inner circumference of the movable guide 18. Upon rotation of die shaft 16 and movable guide 18, a vacuum is naturally formed within the annular space "Y" which helps to bring the cap member 10 undergoing deformation, into contact with the die shaft 16, thus contributing to the avoidance of the formation of wrinkles in the skirt of the finished cap. In the preferred embodiment of FIG. 6, dimension Y is about 0.5 mm, the axial length of the tapered portion 44 of die portion 42 of die shaft 16 is about 30 mm, the maximum O.D. of the movable guide 18 is about 40 mm, dimension "A" is about 5.5 mm and the diameter of tapered portion 44 at its distal end ("B") is about 20 mm. As illustrated in FIG. 6, a cap can be produced having a skirt 14 with a considerable degree of taper by selection of a suitable die shaft 16. By replacing die shaft 16 with a die shaft 16' a cap skirt 14' having a step 40 can be produced.

The dimension "Y" (FIGS. 6 and 7) for the spacing between the outer circumference of the die shaft 16 and the inner surface of the movable guide 18 is $Y\leqq 0.5$ mm. The upper limit for Y is determined by the taper and skirt length of the cap 10. The maximum dimension "Y" for a wine cap is 6 mm, with a skirt length of about 50 mm. If the skirt length for a champagne cap is more than 100 mm, the dimension "Y", will be more than 15 mm. Therefore, "Y" is 0.5 mm$\leqq Y\leqq$15 mm or, more preferably, 0.5 mm$\leqq Y\leqq$6 mm.

As shown in FIG. 9 the angles of contact $\gamma_1$, $\gamma_2$ between the center lines of rollers 34 and 36 and perpendicular with cap skirt 14 may be changed from 0° each, as seen in FIG. 8, to acute angles as depicted in FIG. 9. Normally, $\gamma_1=0$ and $\gamma_2=0$. However, the angle $\gamma_1$ of the rough spinning roller 34 and the angle $\gamma_2$ of the finishing roller 36 can be changed in accordance with the diameter or thickness of the cap. Also, the axial offset distance may be changed from $X_0$ to $X_1$. Finally, the contact pressure may be controlled in accordance with the target skirt thickness and the thickness of the cap blank.

In practice, no problem is created when the thickness of the cylindrical portion of the cap product is gradually reduced toward the opening portion in the above-described manner. The reason for this is explained below. When the finished cap is fitted around a neck portion of a drink bottle, a roll (not shown) is usually pressed against the cap to contour the cap to the bottle neck, causing the cylindrical portion of the cap to elongate toward the opening. Consequently, the thickness of the cap across the length of the cylindrical portion is substantially averaged.

While the present invention has been described above with respect to embodiments wherein the cylindrical portion of the cap has a tapered contour the present invention is not so limited. Alternatively, the present invention may equally be applied to embodiments wherein the cylindrical portion of the cap product does not have a tapered contour. In such embodiments, it is recommended that the die shaft 16 be dimensioned to have a constant outer diameter within the range defined by a predetermined distance as axially measured from the distal end thereof and that the movable guide 18 be dimensioned to have constant inner and outer diameters within the range defined by a predetermined distance as axially measured from the distal end thereof.

In the alternative embodiments wherein the cap product does not have a tapered contour, the cylindrical portion of the cap has a constant thickness of 0.2 mm or less across the full length thereof.

As is apparent from the above description, with the apparatus constructed in the above-described manner, a cap member of which one end is closed with a bottom portion, used as a blank (starting material) for a cap product, can have a very small thickness. Consequently, the weight of the blank can be reduced, resulting in a reduction in material cost.

For example, when aluminum or aluminum alloy having rigidity higher than a conventional soft metallic material such as lead or the like is employed as a metallic material for the cap member, the finished cap can be produced with a reduced thickness across the full length thereof at an inexpensive cost. Another advantage of the cap made of aluminum or aluminum alloy is that it can be reused by melting it.

What is claimed is:

1. A method for producing a thin metallic cap to be fitted around a neck portion of a bottle from a cap-shaped blank having a bottom and an integral cylindrical portion, said method comprising:

providing spinning apparatus including a rotatable die shaft serving as a forming mandrel, a movable, cylindrical guide member surrounding and spaced from the die shaft and mounted for rotation with the die shaft and a pressing member for pressing the cap blank against the distal end of the die shaft to hold the cap blank for rotation with the die shaft, a shaping roller and a finishing roller for shaping the cap blank into a finished cap, the shaping roller and the finishing roller being axially offset and circumferentially offset, through an angle no larger than a right angle, from each other;

mounting the cap blank on the movable cylindrical guide with the cylindrical portion of the cap fitted over the exterior cylindrical surface of the movable cylindrical guide;

pressing the mounted cap blank between the pressing member and the distal end of the die shaft to hold the cap blank for rotation with the die shaft;

rotating the die shaft and cap blank;

pressing the rollers against the cylindrical portion of the cap blank and moving the rollers axially along said cylindrical portion, away from the cap bottom, with the shaping roller leading the finishing roller, shaping the cap blank to the contour of the die shaft with the shaping roller and finishing the exterior surface of the cap blank with the finishing roller; and moving said movable cylindrical guide axially relative to the die shaft, in coordination with axial movement of the rollers, thereby withdrawing the movable cylindrical guide from the cap blank with the rollers pressing the cylindrical portion of the cap blank against the die shaft as the movable cylindrical guide is withdrawn, thus shaping the cap blank to the contour of the outer surface of the die shaft.

2. The method of claim 1 wherein the die shaft has a tapered surface and the cylindrical portion of the cap blank is shaped to a tapered rod configuration by the shaping roller.

3. The method of claim 1 wherein the portion of the die shaft receiving the cap blank has a constant diameter over its length.

4. The method of claim 1 wherein the cap blank is aluminum or aluminum alloy.

5. The method of claim 1 further comprising rotatably driving the pressing member and said movable cylindrical guide, through said cap blank, by rotation of said die shaft.

6. The method of claim 1 wherein said die shaft has a tapered end portion integral with a straight cylindrical portion of constant diameter and wherein an annular space is provided between said straight cylindrical portion and the interior surface of said movable guide member, said method further comprising reducing the pressure within said annular space relative to ambient pressure by said rotating.

7. An apparatus for producing a thin metallic cap to fitted around a neck portion of a bottle from a cap blank, said apparatus comprising:

a rotatable die shaft having a distal end and rotatably mounted at its other end for rotation about a central longitudinal first axis;

a plunger axially aligned with and axially movable against the distal end of said die shaft for securing the cap blank against the distal end of said die shaft;

a movable cylindrical guide surrounding said die shaft, rotatably mounted for rotation about said central longitudinal axis and axially displaceable relative to said die shaft;

a rough spinning roller for reducing the wall thickness of the cap blank and a finishing roller which (1) are axially offset from each other with respect to said first axis so that said finishing roller trails said rough spinning roller in contacting the cap blank to smooth the surface of the cap blank worked by the rough spinning roller and (2) are respectively mounted for rotation around parallel second and third axes which are circumferentially offset from each other at an angle, no larger than a right angle, with respect to said first axis, said finishing roller having a wider circumferential working surface than said rough spinning roller; and means for moving said rollers radially into contact with the die blank and for moving said rollers axially with respect to the die shaft in synchronization with axial movement of said movable cylindrical guide relative to said die shaft, whereby said rollers press the cylindrical portion of the cap blank into contact with the die shaft for reshaping the cap blank, as said movable cylindrical guide moves axially with respect to said die shaft.

8. The apparatus of claim 7 wherein said plunger includes a splined shaft portion, and wherein said apparatus further comprises:

a cylindrical column having a plurality of internal splines for mating with said splined shaft portion;

means for rotatably supporting said cylindrical column and said plunger for rotation with said die shaft; and means for biasing said plunger outward from said cylindrical column against said die shaft, said splined shaft being axially aligned with said die shaft for abutment of said plunger against the distal end of said die shaft.

9. The apparatus of claim 7 wherein said die shaft is tapered so that its diameter is smallest at its distal end.

10. The apparatus of claim 7 wherein said die shaft has at least a distal end portion of constant diameter for receiving the cap blank.

11. The apparatus of claim 7 wherein said plunger unit and said movable cylindrical guide are rotatably driven, through said cap blank, by rotation of said die shaft.

12. The apparatus of claim 7 wherein said rotatable die shaft has a tapered end portion integral with a straight cylindrical portion of constant diameter and wherein an annular gap is provided between said rotatable die shaft and said movable cylindrical guide so that the pressure within said annular space becomes less than ambient pressure upon rotation of said rotatable die shaft and movable cylindrical guide.

* * * * *